United States Patent [19]

Hoshi

[11] Patent Number: 4,565,172

[45] Date of Patent: Jan. 21, 1986

[54] HIGH-PRESSURE FUEL INJECTION SYSTEM FOR DIESEL ENGINE

[75] Inventor: Yoshikazu Hoshi, Ibaraki, Japan

[73] Assignee: Hitachi, Ltd., Tokyo, Japan

[21] Appl. No.: 645,168

[22] Filed: Aug. 28, 1984

[30] Foreign Application Priority Data

Sep. 2, 1983 [JP] Japan ..... 58-160443

[51] Int. Cl.[4] ..... F02M 57/02

[52] U.S. Cl. ..... 123/446; 123/450

[58] Field of Search ..... 123/450, 446, 502, 458; 417/462; 239/88–92

[56] References Cited

U.S. PATENT DOCUMENTS

| | | | |
|---|---|---|---|
| 4,171,099 | 10/1979 | Kopse et al. | 123/446 |
| 4,398,519 | 8/1983 | Tissot et al. | 123/446 |
| 4,401,076 | 8/1983 | Sano et al. | 123/501 |
| 4,407,250 | 10/1983 | Eheim et al. | 123/450 |
| 4,425,894 | 1/1984 | Kato et al. | 123/446 |
| 4,465,049 | 8/1984 | Eckert et al. | 123/446 |
| 4,485,787 | 12/1984 | Kato et al. | 123/501 |

*Primary Examiner*—Magdalen Y. C. Moy

*Attorney, Agent, or Firm*—Antonelli, Terry & Wands

[57] ABSTRACT

A high-pressure fuel injection system for a diesel engine including a plurality of main pumps for injecting fuel each located at one of cylinders of the engine and formed with a fuel injection port, a metering and distributing pump formed with fuel discharge ports corresponding in number to the cylinders of the engine for discharging fuel to be injected in timed relation to the rotation of the engine, a plurality of injected fuel metering valves for metering the fuel to be injected before introduction into the metering and distributing pump, a plurality of pipes for fluidly connecting each of the main pumps for injecting fuel with each other discharge ports of the metering and distributing pump, and an actuating mechanism connecting the engine with each of the main pumps for injecting fuel to actuate each of the main fuel injection pump for injecting fuel in timed relation to the rotation of the engine.

3 Claims, 7 Drawing Figures

HIGH-PRESSURE FUEL INJECTION SYSTEM FOR DIESEL ENGINE

BACKGROUND OF THE INVENTION

1. Field of the Invention

This invention relates to high-pressure fuel injection systems for diesel engines, and more particularly it is concerned with a high-pressure fuel injection system for a diesel engine having pressurized injection means associated with each cylinder of the engine.

2. Description of the Prior Art

In a fuel supply system for a diesel engine, it is the amount of the injected fuel and injection timing that exert great influences on the performance of the engine.

Attempts have been made to optimize control of these two factors by utilizing electronic control techniques, to achieve improved results in controlling them. Methods of effecting control along these lines are disclosed in Japanese Patent Application Laid-Open No. 60851/81 and No. 56660/82, for example.

Even if electronic control techniques are utilized, some problems would be raised when a section of the fuel injection system for compressing the fuel and a section thereof for injecting it are spaced apart a great distance from each other. For example, a time lag caused by the movement of the fuel between the two sections and the behavior of pressure waves would make it impossible to accurately effect control of the amount of the injected fuel and injection timing.

SUMMARY OF THE INVENTION

Object of the Invention

This invention has as its object the provision of a high-pressure fuel injection system for a diesel engine suitable for utilizing electronic control techniques which is capable of avoiding a deterioration in the accuracy and precision with which control of injection timing is effected which might otherwise be caused to occur by a lag in time of the fuel flow in the fuel injecting section behind the fuel flow in the fuel compressing section.

STATEMENT OF THE INVENTION

The outstanding characteristics of the invention are that a control unit for deciding upon the amount of the injected fuel and injection timing is constructed as a single system and the two volumes of fuel decided by the control unit are distributed to the compressing section of each cylinder so as to decide not only the amount of the injected fuel but also the injection timing based on the two volumes of the fuel, and that the two volumes of the fuel for deciding the amount of the injected fuel and injection timing are transferred to the compressing sections of all the cylinders by means of a pressurizing and distributing pump which is commonly shared by the cylinders.

More specifically, means for controlling the amount of the injected fuel and injection timing feed the two volumes of fuel which serve the respective purposes to the pressurizing and distributing pump which admits them to two separate chambers respectively and pressurizes them therein. The two volumes of fuel thus pressurized are successively fed in an orderly manner to two chambers formed in the compressing and injecting section of each cylinder to decide the amount of the injected fuel and injection timing respectively. They are fed to the cylinder at a time when no injection takes place therein in conformity with the order of combustion taking place in the cylinders.

In the compressing section of each cylinder, the desired amount of injected fuel and injection timing can be decided merely by applying mechanical pressure to the fuel.

DESCRIPTION OF THE PREFERRED EMBODIMENT

Figure 1:
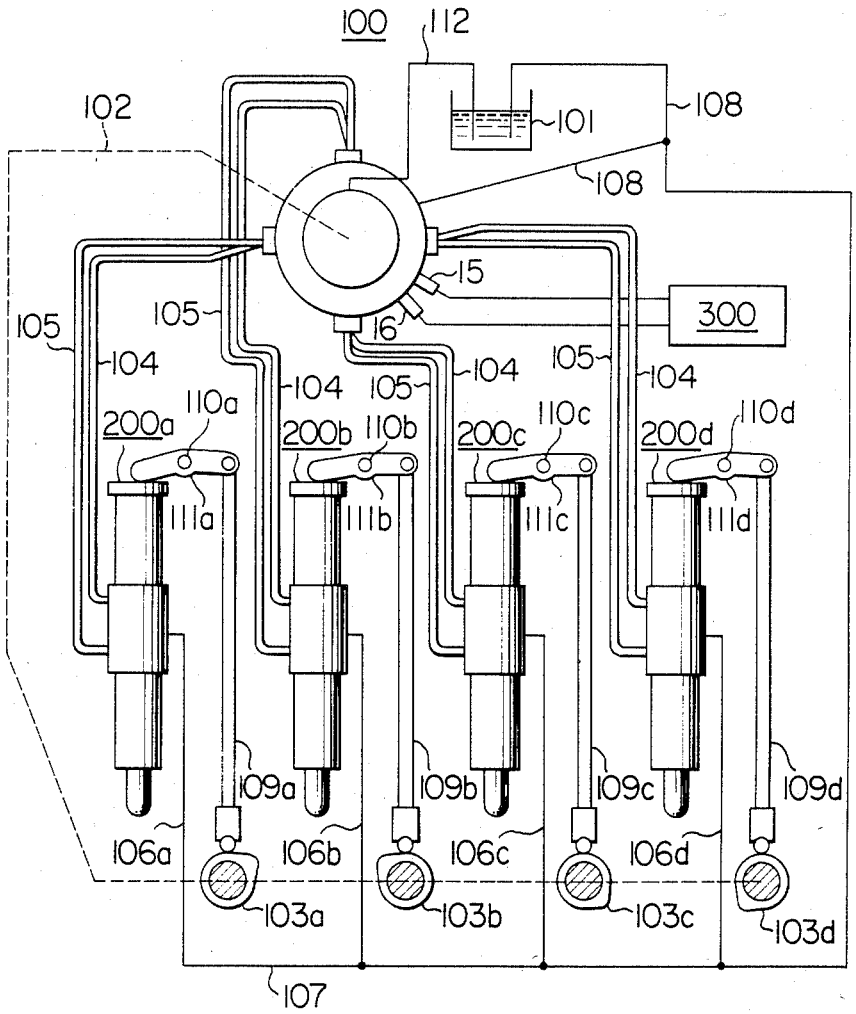
FIG. 1 is a systematic view of the high-pressure fuel injection system comprising one embodiment of the invention.

FIG. 1 is a systematic view of one embodiment of the fuel injection system in conformity with the invention, in which a metering and distributing pump 100 and cams 103*a*–103*d* are driven for rotation by a drive shaft 102 of an engine. The metering and distributing pump 100 draws fuel by suction from a fuel tank 101 through a suction line 112 by means of a built-in feed pump, and pressurizes the fuel to a pressure of several kg/cm$^2$. Two solenoid valves 15 and 16 controlled by commands from a control unit 300 decide upon two volumes of fuel which are pressurized by the metering and distributing pump 100 and fed into the main pumps 200*a*–200*d* via timing pipes 104 and volume regulating pipes 105 at a pressure of several to several scores of atmospheric pressures. The main pumps 200*a*–200*d* are compressed in time relation to injections of fuel into the engine by rocker arms 111*a*–111*d* supported at pivots 110*a*–110*b* via connecting rods 109*a*–109*d* actuated by cams 103*a*–103*d* respectively.

The injection timing is decided by the volume of fuel fed via the timing pipes 104, and the amount of the injected fuel is decided by the volume of fuel fed via the volume regulating pipes 105. The main pumps 200*a*–200*d* are located in the vicinity of the respective cylinders associated therewith.

The fuel overflowing the main pumps 200*a*–200*d* and the fuel discharged from the metering and distributing pump 100 because of being cooled and other reasons flow through overflow lines 106*a*–106*d* and an oil discharge line 107 respectively to a return pipe 108 through which the fuel flows to the fuel tank 101.

Figure 2:
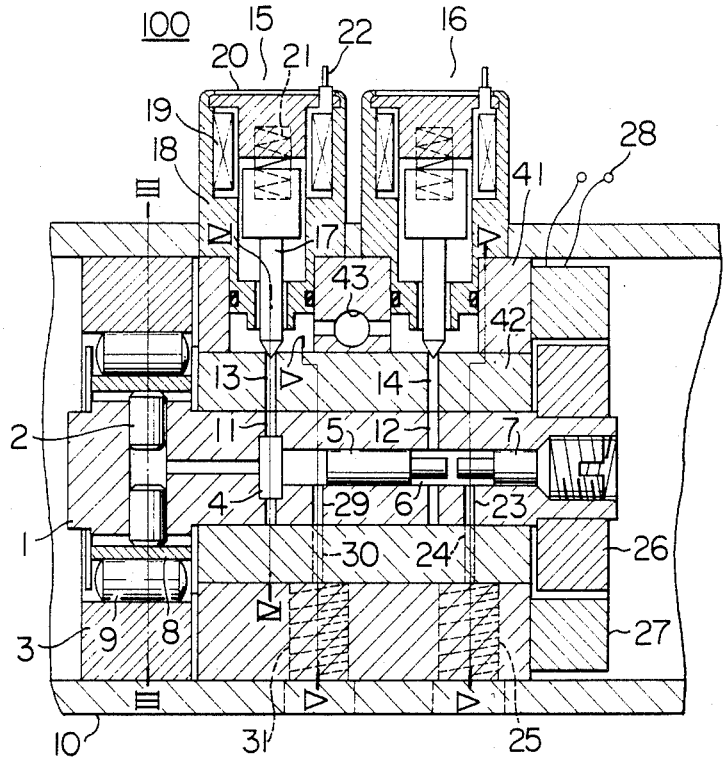
FIG. 2 is a sectional view of the metering and distributing pump.

Various sections of the system will now be described in detail. FIG. 2 is a vertical sectional view of one constructional form of metering and distributing pump 100 in conformity with the invention. The functional object of the metering and distributing pump 100 is to decide, by separate means for controlling the amount of the injected fuel and injection timing respectively, two volumes of fuel fed to the main pumps of the cylinders and to transfer the two volumes of fuel to the main pumps after suitably pressurizing them.

Referring to FIGS. 2–5, the metering and distributing pump 100 comprises a rotor 1 driven for rotation by the drive shaft 102 shown in FIG. 1 rotating in synchronism with the engine. The rotor 1 has mounted at one end portion thereof a pair of plungers 2 fitted in a radial bore, and a roller shoe 8 and a roller 9 located on the outside of each plunger 2. The plungers, roller shoes 8 and rollers 9 rotate with the rotor as a unit.

A cam ring 3 having on its inner peripheral surface four cams 3A of different shapes is supported by a housing 10 and located in such a manner that the cams 3A are kept in contact with the outer peripheral surfaces of the rollers 9. The rotor 1 rotates while being maintained in contact with an inner peripheral surface of a sleeve 42 supported by a sleeve holder 41 secured to the housing 10.

The rotor 1 is formed therein with a first pressurizing chamber 4 and a second pressurizing chamber 6. The first pressurizing chamber 4 is located between the two plungers 2 disposed for sliding movement in the radial bore in face-to-face relation on the left side of the rotor 1 as seen in FIG. 2 and a left end face of a free piston 5 fitted in an axial center bore, and the second pressurizing chamber 6 is located between a right end face of the free piston 5 and a stopper 7 secured to a right end of the axial center bore to avoid fuel leaks.

The plungers 2, roller shoes 8, rollers 9 and cam ring 3 constitute a pressurizing mechanism, which is maintained in communication with the first pressurizing chamber 4.

The first pressurizing chamber 4 is selectively brought into communication with a first discharge passage 29 located radially of the rotor 1 depending on the position of the free piston 5. The second pressurizing chamber 6 is maintained in communication with a second discharge passage 23 located radially of the rotor 1.

Figure 3:
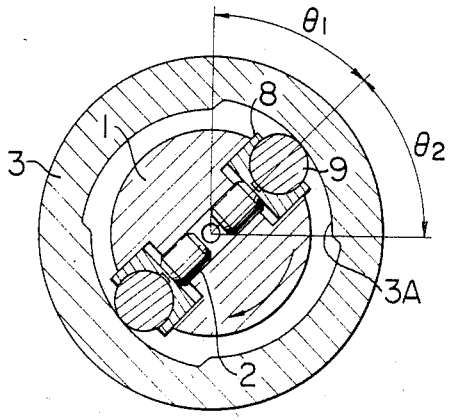
FIG. 3 is a sectional view taken along the line III—III in FIG. 2, in explanation of the compression cam.
Figure 4:
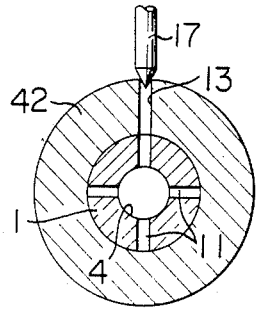
FIG. 4 is a sectional view taken along the line IV—IV in FIG. 2, showing the control section of the metering and distributing pump.

Referring to FIG. 3, the pressurizing mechanism built in the rotor 1 has a suction period $\theta_1$ in which suction of fuel is effected and a compression period $\theta_2$ in which compression and discharge of the fuel are effected which alternately take place as the rotor 1 rotates. FIG. 3 shows the invention as incorporated in a metering and distributing pump of a four-cylinder engine, in which the four cams 3A of different shapes each corresponding to one of the four cylinders are located in one of four equally divided portions of the inner peripheral surface of the cam ring 3. As subsequently to be described, the suction period $\theta_1$ and compression period $\theta_2$ are determined by the shapes of the cams 3A of the cam ring 3 and the volume of liquid (fuel) drawn by suction into the first pressurizing chamber 4.

Referring to FIG. 2 again, the metering and distributing pump 100 shown therein is in a condition in which the compression period has finished or the suction period has just begun. In this condition, the free piston 5 of the pump 100 has moved rightwardly a substantial distance to allow the first pressurizing chamber 4 to communicate with the first discharge passage 29 located radially in the rotor 1 as described hereinabove.

Referring to FIGS. 2–5 in which the pressurizing mechanism is in the suction period, one of a plurality of first radial passages 11 equal in number to the cylinders of the engine (four in this embodiment) which extend radially outwardly from the first pressurizing chamber 4 communicates with a first fixed passage 13 formed in the sleeve 42, and one of a plurality of second radial passages 12 equal in number to the cylinders of the engine (four in this embodiment) which extend radially outwardly from the second pressurizing chamber 6 communicates with a second fixed passage 14 formed in the sleeve 42. The first fixed passage 13 and second fixed passage 14 are closed at ends thereof by armatures 17 of a first solenoid valve 15 and a second solenoid valve 16 respectively.

The solenoid valves 15 and 16 which are substantially of the same construction are each contained in a case 18 in such a manner that the armature 17 is movable vertically in the plane of the figure. The vertical movement of the armature 17 is obtained by turning on and off the respective solenoid valves 15 and 16.

The solenoid valves 15 and 16 each have a coil 19, a fixed magnetic pole 20 and a spring 21 mounted between the fixed magnetic pole 20 and armature 17. The spring 21 normally (when the solenoid valves 15 and 16 are in OFF position) urges the armature 17 to move downwardly in the figure by its biasing force, to keep the valves 15 and 16 closed.

In the solenoid valves 15 and 16, the coil 19 is energized as a current is passed thereto from a terminal 22 to form a magnetic path connecting the fixed magnetic pole 20, case 18 and armature 17 together. The armature 17 moves upwardly by overcoming the biasing force of the spring 21, to open the valves 15 and 16. As the valves 15 and 16 are opened, end portions of the first fixed passage 13 and second fixed passage 14 are released. It is not essential that the valve opening timing for the solenoid valve 15 match that for the solenoid valve 16. However, when the solenoid valves 15 and 16 are opened, fuel pressurized to a suitable pressure level by a feed pump, not shown, driven by an electric motor or an engine, not shown, is fed through the first fixed passage 13 and second fixed passage 14 to the first pressurizing chamber 4 and second pressurizing chamber 6 via the first radial passage 11 and second radial passage 12 which are indexed with the two chambers 4 and 6 respectively (suction).

Figure 5:
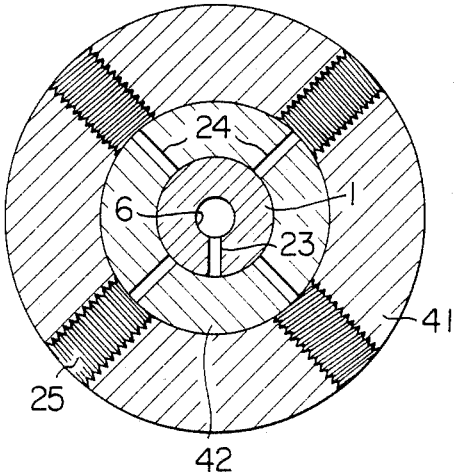
FIG. 5 is a sectional view taken along the line V—V in FIG. 2, showing the discharge section of the metering and distributing pump.

A section taken along a plane V—V including the first discharge passage 29 and a section taken along a plane V—V including the second discharge passage 23 in FIG. 2 are substantially similar to each other. In FIG. 5, parts indicated by reference numerals disposed in a section including the second discharge passage 23 are shown.

The first discharge passage 29 formed in the rotor 1 is brought into communication with one of a plurality of first output passages 30 (in this embodiment, four first output passages 30 equal in number to the cylinders are disposed radially in positions equidistantly spaced apart from each other) formed in the sleeve 42 when they are indexed with each other, and with one of connecting ports 31 formed in the sleeve holder 41. The timing pipes 104 shown in FIG. 1 are each connected with one of the connecting ports 31. Likewise, the second discharge passage 23 formed in the rotor 1 is brought into communication with one of a plurality of second output passages 24 (in this embodiment, four second output passages 24 equal in number to the cylinders are disposed radially in positions equidistantly spaced apart from each other) formed in the sleeve 42 when they are indexed with each other, and with one of connecting ports 25 formed in the sleeve holder 41. The volume regulating pipes 105 shown in FIG. 1 are each connected with one of the connecting ports 25.

The solenoid valves 15 and 16 are connected at their upstream ends with a fuel supply port 43 to feed fuel pressurized to a predetermined pressure level to each of the first pressurizing chamber 4 and second pressurizing chamber 6 via the first fixed passage 13 and second fixed passage 14 respectively, when each other solenoid valves 15 and 16 is opened.

A pulser 26 is mounted to a right end portion of the rotor 1 and rotates therewith as a unit. A detector 27 is fixedly mounted to an outer periphery of the pulser 26 to cooperate therewith. The pulser 26 and detector 27 are similar to a rotating position detector of a contactless ignition system of a spark ignition type engine, for example, and supply an electrical output signal to a detection terminal 28 when the rotor 1 moves to a position corresponding to a fuel feed initiating time (the time at which each of the solenoid valves 15 and 16 is opened and begins to draw fuel by suction) in this embodiment.

Operation of controlling the volumes of fuel drawn by suction in the suction period $\theta_1$ shown in FIG. 3 will be described.

The electronic control unit 300 shown in FIG. 1 receives a signal from the detection terminal 28 indicating that the time for commencing the suction period has been reached and opens the first solenoid valve 15 and second solenoid valve 16, either simultaneously or with a time lag, immediately after receiving the signal from the terminal 28 or with a suitable delay. When the first solenoid valve 15 is opened, the fuel pressurized to a predetermined pressure level is fed through the fuel supply port 43 into the first pressurizing chamber 4 via the first fixed passage 13 and first radial passage 11. At this time, the rotor 1 has rotated to a position in which the rollers 9 and roller shoes 8 are in contact with the cam 3A on the inner peripheral surface of the cam ring 3 which is configured such that the movements of the rollers 9 and roller shoes 8 are not suppressed (the suction period $\theta_1$ shown in FIG. 2), to allow the rollers 2 to move radially outwardly.

Thus, the fuel is fed into the first pressurizing chamber 4 in a volume which is decided by the period of time in which the solenoid valve 15 is open, the dimensions of the passages and the difference between the pressure in the fuel supply port 43 and the pressure in the first pressurizing chamber 4. That is, in spite of whether the system has a characteristic such that the pressure in the supply port 43 is constant regardless of the rotational speed of the pump or varied depending on the rotational speed of the pump, the characteristic is decided upon by taking into consideration the influences exerted by centrifugal forces acting on the plungers 2. However, in actual practice, it is possible to control the volume of the fuel fed into the first pressurizing chamber 4 based merely on the duration or period of time in which the first solenoid valve 15 remains open.

Likewise, as the second solenoid valve 16 is opened, it is possible to control the volume of the fuel (liquid) fed into the second pressurizing chamber 6. The liquid (fuel) fed into the second pressurizing chamber 6 causes the free piston 5 to shift leftwardly in FIG. 2 to increase the pressure in the first pressurizing chamber 4 and move the plungers 2 radially outwardly. The system is constructed such that the leftward movement of the free piston 5 closes the first discharge passage 29.

In this way, the free piston 5 is caused to shift leftwardly in FIG. 2 in conformity with the volume of the fuel (liquid) fed into the second pressurizing chamber 6. The plungers 2 are moved radially outwardly a distance corresponding to the volume of the fuel fed into the second pressurizing chamber 6 plus the volume of the fuel fed into the first pressurizing chamber 4.

In the control operation described hereinabove, the pressurizing mechanism composed of the plungers 2, roller shoes 8 and rollers 9 operates in such a manner that the suction period allowing the fuel to flow freely into the pressurizing chambers 4 and 6 exists.

Operation of controlling the volumes of the fuel discharged in the compression period $\theta_2$ will now be described.

In the compression period, as shown in FIG. 2, the rollers 9 and roller shoes 8 are in contact with the cam 3A configured such that they are pressed radially inwardly by the cam 3A, to move the plungers radially inwardly.

The first radial passage 11 and first fixed passage 13 maintained in communication with each other and the second radial passage 12 and second fixed passage 14 maintained in communication with each other in the suction period are brought out of communication with each other in the compression period.

At the same time, the discharge passage 23 connected with the second pressurizing chamber 6 is brought into communication with one of the output passages 24 (which are equal in number to the cylinders) connected with the respective connecting ports 25 (see FIG. 5). The volume regulating pipes 105 shown in FIG. 1 are connected at one end with the respective connecting ports 25 and at the opposite end with the main pumps 200 of the respective cylinders. During the compression period, the first discharge passage 29 connected with the first pressurizing chamber 4 is closed by the free piston 5.

As the rotor 1 rotates, the cam 3A of the configuration restraining the movement of the rollers 9 and roller shoes 8 moves the plungers 2 radially inwardly, to thereby compress the liquid (fuel) drawn by suction into the first pressurizing chamber 4 and raise its pressure.

At the time when the fuel in the first pressurizing chamber 4 is pressurized and its pressure rises, the fuel in the second pressurizing chamber 6 is pressurized through the free piston 5 and its pressure also rises, because the first discharge passage 29 is closed by the free piston 5. The fuel in the second pressurizing chamber 6 thus pressurized is fed via the second discharge passage 23, output passage 24 and connecting port 25 to each of the main pumps 200.

As the fuel is discharged from the second pressurizing chamber 6, the free piston 5 shifts rightwardly to the position shown in FIG. 2. When the free piston 5 is in the position shown in FIG. 2, the first discharge passage 29 is connected with one of the output passages 30 (equal in number to the cylinders), so that the fuel is fed into the main pumps 200 of the corresponding cylinders through the output passage 30 and connecting port 31 to each of the main pumps 200 for the cylinders via the timing pipes 104 shown in FIG. 1.

As the rotor 1 further rotates and enters the next following suction period, the free piston 5 shifts leftwardly a distance corresponding to the volume of the fuel drawn by suction into the second pressurizing chamber 6. The liquid (fuel) drawn by suction into the second pressurizing chamber 6 corresponds in volume to the fuel discharged through the second discharge passage 23 in the next following compression period until the first discharge passage 29 is opened. Thus, by controlling the period of time in which the second solenoid valve 16 is open, it is possible to transfer the volume of fuel drawn by suction into the second pressurizing chamber 6 to the main pump 200 through the volume regulating pipe 105 in the compression period.

Meanwhile, by controlling the period of time in which the first solenoid valve 15 is open, it is possible to transfer the volume of fuel drawn by suction into the first pressurizing chamber 4 to each main pump 200 via the timing pipe 104.

These volumes of fuel are used for deciding the final amount of the fuel injected and injection timing subsequently to be described.

Referring to FIG. 3, the cam ring 3 which is fixed is formed on its inner peripheral surface with portions of the cams 3A for deciding the suction period $\theta_1$ and the compression period $\theta_2$ which are arranged alternately. The portion of the cams 3A for the suction period $\theta_1$ is configured such that the movement of the plungers 2, roller shoes 8 and rollers 9 radially outwardly of the rotor 1 is not restrained, and the portion of the cams 3A for the compression period $\theta_2$ is configured such that as the rotor 1, roller shoes 8 and rollers 9 rotate, they are gradually urged to move radially outwardly of the rotor 1, so that the movement of the plungers 2 radially inwardly of the rotor 1 pressurized the liquid in the first pressurizing chamber 4.

When the period of time in which the first solenoid valve 15 remains open is prolonged, the volume of the fuel fed into the first pressurizing chamber 4 is great and the distance covered by the movement of the plungers 2 radially outwardly of the rotor 1 is great. Thus, the roller 9 are brought into contact with the cam 3A of the necessary shape on the cam ring 3 earlier than would be the case if the distance were smaller, and the compression period $\theta_2$ starts earlier to allow the fuel to be compressed and transferred earlier than would be the case if the distance were smaller. When the period of time in which the second solenoid valve 16 remains open is prolonged and the volume of the liquid drawn by suction into the second pressurizing chamber 6 is great, the free piston 5 is biased leftwardly, and the plungers 2 project radially outwardly of the rotor 1 with the volume of the liquid drawn by suction into the first pressurizing chamber 4 remaining constant. Therefore, the compression period $\theta_2$ would begin earlier for the same reason as described hereinabove.

Stated differently, the time at which transfer of the volumes of the liquid is commenced may vary depending on the volumes of the liquid transferred through the timing pipes 104 and volume regulating pipes 105 to the main pumps 200*a*–200*d*. This raises no problem for the engine because it takes place in other periods than the compression period $\theta_2$ of the corresponding main pump 200.

Figure 6:
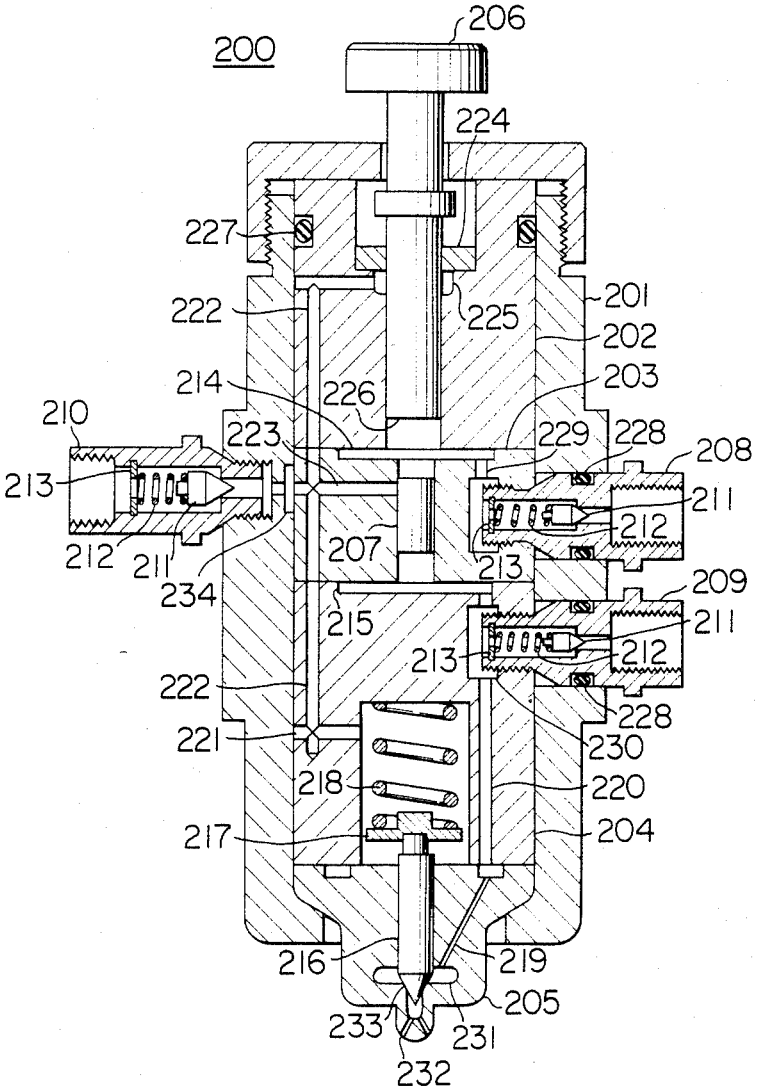
FIG. 6 is a sectional view of the main pump, showing its construction.

The main pumps 200*a*–200*d* will now be described by referring to FIG. 6.

Each main pump 200 comprises a body 201 mounted to one of the cylinders of the engine and having mounted therein a pressurizing body member 202 sealed by a seal member 227, a shuttle body member 203, a discharge body member 204 and a nozzle body member 205. The nozzle body member 205 is disposed in the body 201 in such a manner that it protrudes into a combustion chamber of the engine. The four body members 202, 203, 204 and 205 are finished in such a manner that surfaces thereof maintained in contact with each other are sufficiently flat to provide an oiltight seal therebetween. The pressurizing body member 202 is formed in its central portion with a vertical bore in which a main plunger 206 is fitted for vertical sliding movement in a manner to define a pressurizing space 226 beneath the main plunger 206. The pressurizing space 226 is maintained in communication with an upper space 214 formed in an upper portion of the shuttle body member 203, and a timing space 229 formed as a timing connector 208 is threadably connected to the shuttle body member 203.

The shuttle body member 203 is formed with a center vertical bore for fitting therein a shuttle 207 for vertical sliding movement, and a lower space 215 is formed beneath the shuttle 207. The lower space 215 is maintained in communication with a volume regulating space 230 formed as a volume regulating connector 209 is threadably connected to the discharge body member 204, a high-pressure vertical bore 220, an angling duct 219 formed in the nozzle body member 205 and an injection space 231. Supported in a central portion of the nozzle body member 205 for sliding movement is a needle 216 which is forced against a seat 233 by the biasing force of a spring 218 exerted thereon through a spring receiver 217. A space formed in the discharge body 204 for mounting the spring 218 is communicated with a discharge vertical bore 222 via a discharge horizontal bore 221. The center vertical bore formed in the shuttle body member 203 for supporting the shuttle 207 is communicated with the discharge vertical bore 222 via an overflow passage 223. The discharge vertical bore 222 is also communicated with a free space 225 disposed in a manner to surround the center bore for supporting the main plunger 206. The discharge vertical bore 222 is maintained in communication with a discharge space 234 formed in the body 201.

All the spaces shown and described hereinabove are filled with fuel when the system is in operation.

An overflow connector 210 is threadably connected to the body 201 in a manner to communicate with the discharge space 234, and an overflow pipe 106 shown in FIG. 1 is connected to the body 201 through the connector 210. The timing connector 208 is connected to the body 201 in such a manner that it is communicated with the timing space 229, and the timing pipe 104 shown in FIG. 1 is connected to the body 201 through the timing connector 208. The volume regulating pipe 105 shown in FIG. 1 is connected to the body 201 through the volume regulating connector 209 in such a manner that it is communicated with the volume regulating space 230.

In each of the connectors 208, 209 and 210, a check valve 211 is mounted and a spring 212 is connected at one end to a locker 213 and at the other end to the valve in such a manner that the valve 211 is biased by the spring 212 into engagement with an opening of an inner passage of the connector to allow the liquid to flow therethrough only in one direction. The connectors 208 and 209 are sealed by a seal member 228 with respect to the body 201, and allow the liquid to flow from outside into the main pump 200. The connector 210 allows the liquid to flow from the main pump 200 to outside.

Operation of the main pump 200 of the aforesaid construction will now be described. As described hereinabove, the volume of fuel which is to be finally injected into the cylinder flows into the volume regulating space 230 through the volume regulating pipe 105 and volume regulating connector 210 by opening the check valve 211. The volume of fuel further flows into the lower space 215 and forces the shuttle 207 to move upwardly because the main plunger 206 is not restrained by the cam 103, connecting rod 109 and rocker arm 111. Thus, the fuel contained in the upper space 214 and pressurizing space 226 is also pressurized, to pressurize the fuel in the timing space 229 communicated with the pressurizing space 226.

As described hereinabove, inflow of the fuel through the timing pipe 104 and timing connector 108 into the body 201 takes place after inflow of the fuel through the volume regulating connector 209 is terminated. The check valve 211 in the timing connector 208 avoids outflow of the fuel from the body 201 to outside, and the plunger 206 which is not restrained moves upwardly a distance corresponding to the distance covered by the upward movement of the shuttle 207 which closes the overflow passage 223 by its outer periphery. Then, the inflow of the fuel through the volume regulating connector 209 is terminated, and the inflow of the fuel through the timing connector 208 is commenced.

The fuel which forces the check valve 211 in the timing connector 208 to move to an open position flows into the pressurizing chamber 226 via the timing space 229 and upper space 214. The pressure of the fuel acts on the shuttle 207. However, since the check valve 211 in the volume regulating connector 209 communicated with a lower portion of the shuttle 207 is closed and the pressure is not high enough to move the needle 216 upwardly from the injection space 231, only the main plunger moves upwardly.

Stated differently, the shuttle 207 and main plunger 206 move upwardly in conformity with the volume of the fuel flowing into the body 201 via the volume regulating connector 209, and the main plunger 206 further moves upwardly in conformity with the volume of the fuel flowing into the body 201 via the timing connector 208.

When the time for the particular cylinder of the engine to require fuel injection comes, the cam 103 actuates the connecting rod 109 to move upwardly and a portion of the rocker arm 111 corresponding to a head of the main plunger 206 begins to move downwardly. If the main plunger 206 is disposed in an upper position under the influence of the volume of the fuel flowed into the body 201 as described hereinabove, then the main plunger 206 has a compressive force exerted thereon at an early period of the rotation of the engine.

The compressive force exerted on the main plunger 206 pressurizes the fuel in the pressurizing space 226 through the plunger 206. At this time, the fuel communicated with the pressurizing space 226 has its pressure transmitted to the lower portion of the main plunger 206 through the plunger 206, because the check valve 211 in the timing connector 208 is closed and the overflow passage 223 is closed by the outer periphery of the shuttle 207. The fuel in the lower space 215 does not flow therefrom because the check valve 211 in the volume regulating connector 209 is closed but flows into the injection space 231 via the high-pressure vertical bore 220 and angling duct 219, with a result that the pressure in the injection space 231 acts on the 216. When the pressure acting on the needle 216 overcomes the biasing force of the spring 218 urging the needle 216 to move upwardly, the needle 216 moves upwardly and allows the fuel to be injected through the injecting port 232 into the cylinder associated with the main pump 200. As the main plunger 206 further moves downwardly and the fuel beneath the shuttle 207 is injected and allows the shuttle 207 to move downwardly, the overflow passage 223 which has been closed by the outer periphery of the shuttle 207 is brought into communication with the pressurizing space 226. Further downward movement of the main plunger 206 allows the fuel in the pressurizing space 226 to be returned to the tank 101 through the overflow passage 223 and discharge space 234, and through the overflow pipe 106 connected to the overflow connector 210 after opening the check valve 211 which is opened with a relatively low force.

The inflow of the fuel through the timing connector 208 into the body 201 that takes place after the inflow of the fuel has taken place through the volume regulating connector 209 as described hereinabove forces the shuttle 207 which remains stationary to move upwardly. The force that forces the main plunger 206 to move downwardly after the shuttle 207 has been moved upwardly causes the shuttle 207 to be restored to the position in which it remained stationary before. Thus, the fuel flowing into the body 201 through the volume regulating connector 209 as described hereinabove constitute the amount of the fuel that is finally injected.

As described hereinabove, in the embodiment of the present invention, the inflow of the fuel into the body 201 of the main pump 200 takes place in an orderly manner such that the fuel first flows to the portion of the body below the shuttle 207 and, after the overflow passage 223 is closed by the outer periphery of the shuttle 207, only the main plunger 206 is moved upwardly by the fluid.

This avoids the trouble that the fuel might flow to outside through the overflow passage 223 if it is allowed to flow into the portion of the body 201 above the shuttle 207 while the overflow passage 223 is still open.

The arrangement whereby the amount of the injected fuel and injection timing are decided by the single means offers the advantage that no variations occur between the cylinders in the amount of the injected fuel and injection timing, making it possible to effect fuel injection economically with a high degree of efficiency.

The two volumes of the fuel for deciding the amount of the injected fuel and injection timing respectively are pressurized and distributed by the single pressurizing mechanism. This is conducive to increased compactness and reduced cost of the metering and distributing mechanism.

The supply of the two volumes of the fuel for deciding the amount of the injected fuel and injection timing to each of the main pumps takes place in an orderly manner, so that the performance of the system is stabilized.

The two volumes of the fuel for deciding the amount of the injected fuel and injection timing are metered under low pressure. This enables a metering device of high ability to withstand pressure to be obtained at low cost.

The transfer of the fuel from the metering and distributing pump to each of the main pumps is achieved under any pressure desired, so that production of air bubbles can be avoided and the ability of the system as a whole to withstand pressure can be set at a suitable level. This allows the fuel injection system to be produced readily at low cost.

In transferring the fuel from the metering and distributing pump to each of the main pumps, it is possible to select the period of time for the transfer with great latitude because the non-compression period of each cylinder is substantially prolonged.

Figure 7:
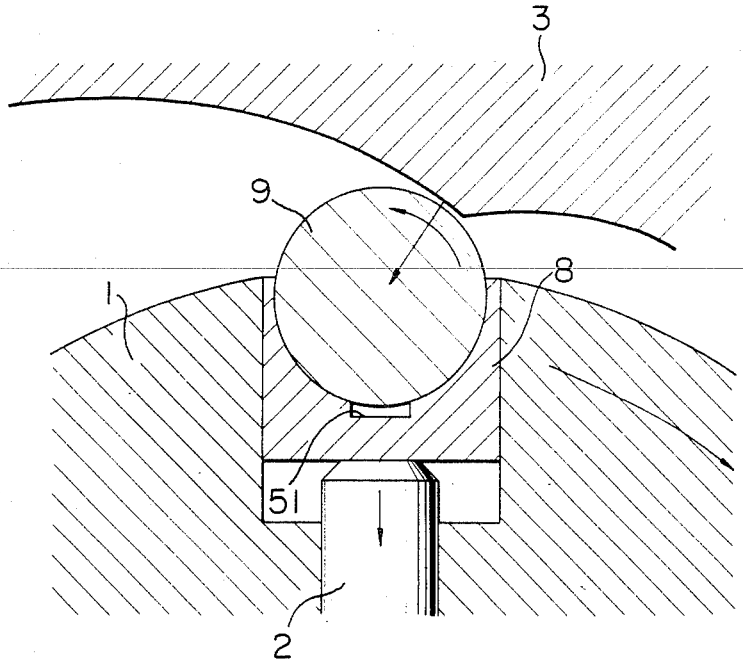
FIG. 7 is a fragmentary enlarged view of the roller and roller shoe shown in FIG. 3.

FIG. 7 shows, on an enlarged scale, portions of the roller shoe 8 and roller 9 in contact with each other. The force exerted by the cam ring 3 is transmitted to the plunger 2 through the roller 9 and roller shoe 8. At this time, a force of great magnitude is transmitted to a contact surface (hemispherical surface) of the roller shoe 8 from the roller 9. Because particles of the materials of various parts of the pump produced by wear and contact tend to accumulate on the contact surface and increase after a prolonged period of use, contact of the roller 9 with the cam 3A of the cam ring 3 could become lopsided. In the embodiment shown and described hereinabove, a discharge groove 51 is formed at the contact surface of the roller shoe 8 to facilitate discharge of the particules accumulating as noted hereinabove. This allows the aforesaid trouble to be avoided by keeping the contact surface of the roller shoe 8 clean at all times and avoiding wear that might otherwise be caused on the roller 9 and cam ring 3.

The arrangement whereby control of the amount of the injected fuel and injection timing is effected in the vicinity of each cylinder of the engine before fuel injection finally takes place enables control to be effected with a high degree of accuracy and precision because the influences exerted by a delay in transmission and waves of reflection can be minimized.

What is claimed is:

1. A high-pressure fuel injection system for a diesel engine comprising:

(a) a plurality of main pumps for injecting fuel each located at one of cylinders of the engine and formed with a fuel injecting port, each said main pump for injecting fuel being formed with a first injected fuel space filled with fuel to be injected, a discharge valve located in a path connecting said first injected fuel space with said fuel injecting port, said discharge valve being opened when the fuel to be injected reaches a predetermined pressure level, a first injection timing fuel space fluidly connected with said first injected fuel space through a movable shuttle and filled with injection timing fuel, and a plunger varying the volume of said first injection timing fuel space;

(b) a metering and distributing pump formed with injection fuel outputs and injection timing fuel outlets corresponding in number to the cylinders of the engine for discharging fuel in timed relation to the rotation of the engine, said metering and distributing pump being formed with a second injected fuel space filled with the fuel to be injected and brought into communication with said injected fuel outlets in timed relation to the rotation of the engine, and a second injection timing fuel space filled with injection timing fuel fluidly communicated with said second injected fuel space through a movable free piston and communicated with said injection timing fuel outlets in timed relation to the rotation of the engine and equipped with pump means for compressing the fuel in said second injection timing fuel space in timed relation to the rotation of the engine;

(c) a plurality of fuel metering valves for metering fuel flowing into said second injected fuel space and second injection timing fuel space respectively;

(d) a plurality of pipes for fluidly connecting said first injected fuel space and first injection timing fuel space of each said main pump for injecting fuel with said injected fuel outlets and injection timing fuel outlets of said metering and distributing pump respectively; and (e) a rocker arm mechanism for driving the plunger of each said main pump for injecting fuel in timed relation to the rotation of the engine.

2. A high-pressure fuel injection system for a diesel engine as claimed in claim 1, wherein said plurality of fuel metering valves each comprise a solenoid valve.

3. A high-pressure fuel injection system for a diesel engine comprising:

(a) a metering and distributing pump formed with injection fuel outlets and injection timing fuel outlets corresponding to the number of cylinders of the engine for respectively discharging injection fuel and injecting timing fuel in synchronous relation to the rotation of the engine;

(b) an injection fuel metering valve means and injection timing fuel metering valve means for respectively metering the fuel to be injected and the fuel for defining fuel injection timing before introduction into said metering and distributing pump;

(c) a feed pump for supplying fuel to said injection fuel metering valves and said injection timing fuel metering valves;

(d) a fuel injecting main pump located at each cylinder of the engine and formed with an injection fuel space filled with fuel to be injected, an injection timing fuel space filled with fuel for defining fuel injection timing, and a fuel injecting port, said fuel in said injection fuel space being discharged through said fuel injection port by raising the pressure of the fuel in said injection timing fuel space, and then transmitting the raised pressure to the fuel in said injection fuel space;

(e) pipe means for connecting said injection fuel space and said injection timing fuel space of each main pump with said corresponding injection fuel outlet and injection timing fuel outlet of said metering and distributing pump; and (f) transmission means for controlling the fuel pressure in said injection timing fuel space of each main pump in synchronous relation to the rotation of the engine.

* * * * *